US007657376B2

(12) United States Patent
Newman

(10) Patent No.: US 7,657,376 B2
(45) Date of Patent: Feb. 2, 2010

(54) METHOD AND SYSTEM FOR EVALUATING WEIGHT DATA FROM A SERVICE RIG

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 0 days.

(21) Appl. No.: 11/827,052

(22) Filed: Jul. 10, 2007

(65) Prior Publication Data

US 2007/0288169 A1 Dec. 13, 2007

Related U.S. Application Data

(62) Division of application No. 11/516,105, filed on Sep. 5, 2006, now Pat. No. 7,359,801.

(60) Provisional application No. 60/716,612, filed on Sep. 13, 2005.

(51) Int. Cl.
*G01V 3/18* (2006.01)
*G06F 19/00* (2006.01)

(52) U.S. Cl. ..... 702/6; 702/9

(58) Field of Classification Search ..... 702/9, 702/35, 42, 69, 182, 6; 175/40, 48, 50; 166/383; 73/61.62

See application file for complete search history.

(56) References Cited

U.S. PATENT DOCUMENTS 5,178,006 A * 1/1993 Wicks et al. ..... 73/152.29
6,079,490 A 6/2000 Newman
6,377,189 B1 4/2002 Newman
6,516,879 B1 * 2/2003 Hershberger ..... 166/250.03
6,728,638 B2 4/2004 Newman
7,006,009 B2 2/2006 Newman
7,006,920 B2 2/2006 Newman et al.
7,064,677 B2 6/2006 Newman
2004/0162658 A1 8/2004 Newman
2004/0226712 A1 11/2004 Hood et al.
2005/0114001 A1 5/2005 Newman
2005/0269083 A1 * 12/2005 Burris et al. ..... 166/255.2
2006/0136133 A1 * 6/2006 Woerpel et al. ..... 702/9

* cited by examiner

*Primary Examiner*—Bryan Bui
(74) *Attorney, Agent, or Firm*—King & Spalding LLP

(57) ABSTRACT

The present invention is directed to methods for an off-site supervisor or well owner to evaluate the rig load data provided by a well service rig at a well site by evaluating charts of sensor data obtained from sensors on or associated with the well service rig. A rig load data chart can be reviewed and activities completed by the rig identified based on the data curves on the rig load data chart. In addition the hook load carried by the service rig can be determined by evaluating the rig load data charts of sensor data. Furthermore, well bore and tubing conditions in the well can be analyzed based on the rig load data in the rig load data charts while tubing and rods are being pulled from the well or well bore.

22 Claims, 15 Drawing Sheets

METHOD AND SYSTEM FOR EVALUATING WEIGHT DATA FROM A SERVICE RIG

CROSS REFERENCE TO RELATED PATENT APPLICATIONS

This application is a divisional of and claims priority to U.S. patent application Ser. No. 11/516,105, filed Sep. 5, 2006, now U.S. Pat. No. 7,359,801 entitled, "Method and System for Evaluating Weight Data From a Service Rig" which claims priority under 35 U.S.C. § 119 to U.S. Provisional Patent Application No. 60/716,612, titled Interpretive Techniques Using Sensor Data, filed Sep. 13, 2005, the entire contents of both being herein incorporated by reference.

FIELD OF THE INVENTION

The subject invention generally pertains to equipment used for repairing wells that have already been drilled. More specifically the present invention pertains to an analysis of rig load data received from well service rigs to determine different aspects of the service provided.

BACKGROUND OF THE INVENTION

After a well has been drilled, it must be completed before it can produce gas or oil. Once completed, a variety of events may occur to the formation causing the well and its equipment to require a "work-over." For purposes of this application, "work-over" and "service" operations are used in their very broadest sense to refer to any and all activities performed on or for a well to repair or rehabilitate the well, and also includes activities to shut in or cap the well. Generally, work-over operations include such things as replacing worn or damaged parts (e.g., a pump, sucker rods, tubing, and packer glands), applying secondary or tertiary recovery techniques, such as chemical or hot oil treatments, cementing the well bore, and logging the well bore, to name just a few. Service operations are usually performed by or involve a mobile work-over or well service rig (collectively hereinafter "service rig" or "rig") that is adapted to, among other things, pull the well tubing or rods and also to run the tubing or rods back in. Typically, these mobile service rigs are motor vehicle-based and have an extendible, jack-up derrick complete with draw works and block. In addition to the service rig, additional service companies and equipment may be involved to provide specialized operations. Examples of such specialized services include: a chemical tanker, a cementing truck or trailer, a well logging truck, perforating truck, and a hot-oiler truck or trailer.

It is conventional for a well owner to contract with a service company to provide all or a portion of the necessary work-over operations. For example, a well owner, or customer, may contract with a service rig provider to pull the tubing from a specific well and contract with one or more service providers to provide other specific services in conjunction with the service rig company, so that the well can be rehabilitated according to the owner's direction.

It is typical for the well owner to receive individual invoices for services rendered from each company that was involved in the work-over. For example, if the portable service rig spent thirty hours at the well site, the customer well owner will be billed for thirty rig hours at the prevailing hourly rate. The customer is rarely provided any detail on this bill as to when the various other individual operations were started or completed, the speed at which the operations took place, how much material was used, or whether any problems were encountered in the well. Occasionally, the customer might be supplied with handwritten notes from the rig operator, but such is the exception, not the rule. Similarly, the customer will receive invoices from the other service companies that were involved with working over the well. The customer is often left with little to no indication of whether the service operations for which it is billed were done properly, and in some cases, even done at all. Further, most well owners own more than one well in a given field and the invoices from the various companies may confuse the well name with the services rendered. Also, if an accident or some other notable incident occurs at the well site during a service operation, it may be difficult to determine the root cause or who was involved because there is rarely any documentation of what actually went on at the well site. Of course, a well owner can have one of his agents at the well site to monitor the work-over operations and report back to the owner, but such "hands-on" reporting is often times prohibitively expensive.

The present invention is directed to evaluating rig load data provided to a chart in a display from sensors on the service rig to determine the activities accomplished by the service rig, the hook load carried during an activity by the service rig and well bore conditions evaluated by reviewing the rig load data during the removal of tubes and rods from a well or well bore.

SUMMARY OF THE INVENTION

The present invention is directed to incrementing a well service rig in such a manner that activity-based and/or time-based data for the well site is recorded and evaluated. The invention contemplates that the acquired data can be transmitted in near real-time or periodically via wired, wireless, satellite or physical transfer such as by memory module to a data center preferably controlled by the service rig owner, but alternately controlled by the well owner or another.

For one aspect of the present invention, a method of determining the activity completed by a service rig at a well site can be achieved by analyzing a rig load chart comprising rig load data. The rig load chart can be displayed on a monitor or provided in hard copy and can be evaluated by a rig operator, supervisor, rig owner, well owner, or other interested party. A grouping of rig load data can be identified and determined to be a first activity. The first activity on the rig load data chart can be evaluated to determine what the activity is. Once determined the activity can be recorded in a computer storage medium, such as a hard drive, compact disc, floppy disc or other storage medium known to those or ordinary skill in the art.

For another aspect of the present invention, a method of determining well bore conditions can be achieved by analyzing rig load data on a rig load data chart. The rig load chart can be displayed on a monitor or provided in hard copy and can be evaluated by a rig operator, supervisor, rig owner, well owner, or other interested party. A grouping of rig load data can be identified and determined to be a first activity. The first activity on the rig load data chart can be evaluated to determine what the activity is. If the first activity is determined to be pulling at least one string of tubing from the well bore, and evaluation can be conducted to determine if there are any rig load data points on the rig load chart that are abnormally high. In one exemplary embodiment, a determination of whether a rig load data value is abnormally high is based on a determination of whether the rig load data value is substantially above an average upper value for the rig loads during that activity. If there are not abnormally high rig load data values, the well bore status can be designated as normal.

For yet another aspect of the present invention, a method of determining the hook load on a well service rig can be achieved by analyzing rig load data curves on a rig load data chart. The rig load chart can be displayed on a monitor or provided in hard copy and can be evaluated by a rig operator, supervisor, rig owner, well owner, or other interested party. A first rig load level can be selected from a data point that is substantially along a peak of the rig load data curve on the display. A second rig load level can be selected from a data point that is substantially along a trough of the rig load data curve immediately preceding or subsequent to the peak of the first rig load level. The hook load can then be calculated by taking the difference of the first rig load level and the second rig load level.

BRIEF DESCRIPTION OF DRAWINGS

For a more complete understanding of the exemplary embodiments of the present invention and the advantages thereof, reference is now made to the following description in conjunction with the accompanying drawings in which.

DETAILED DESCRIPTION OF THE EXEMPLARY EMBODIMENTS

Figure 1:
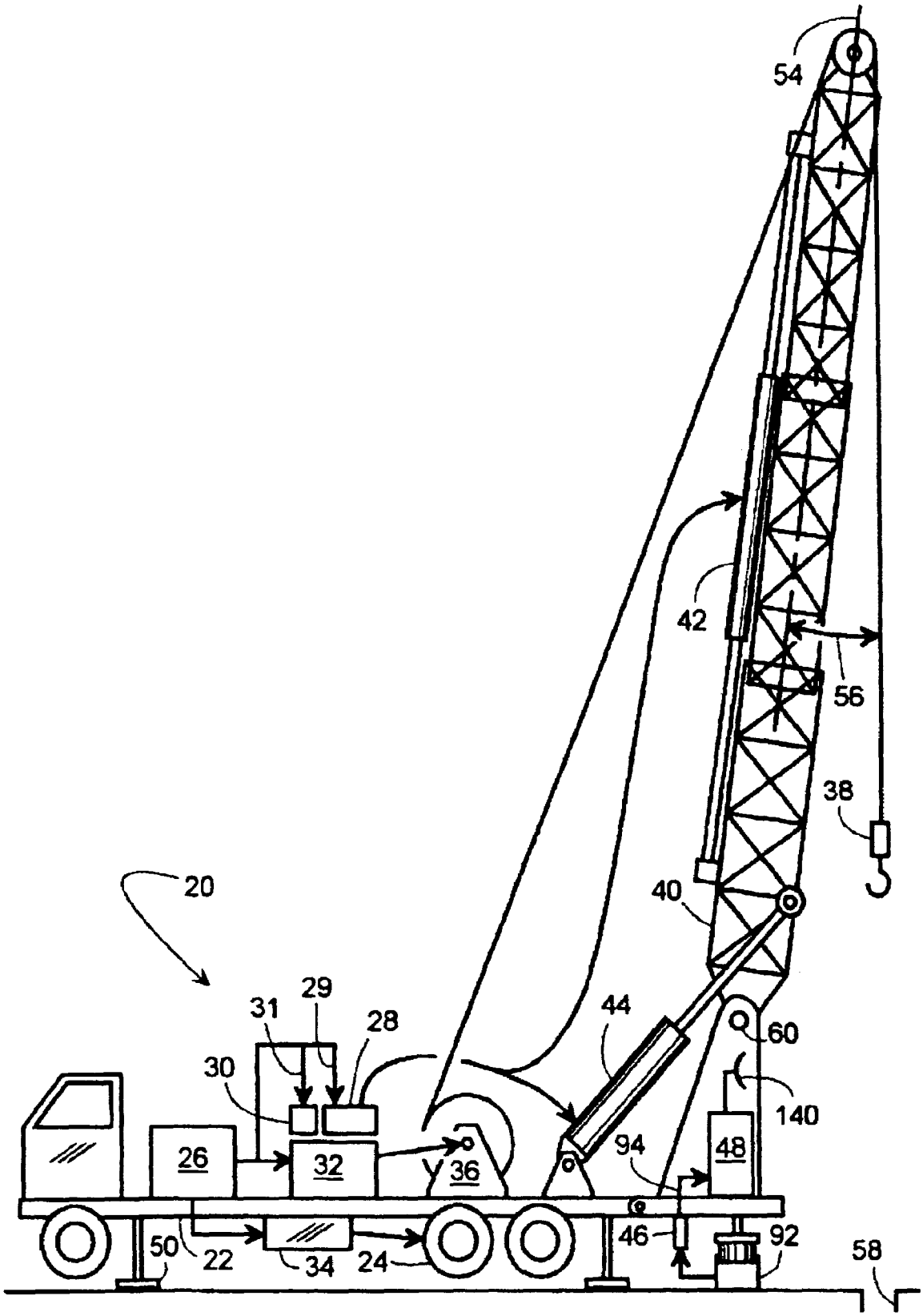
FIG. 1 is a side view of an exemplary mobile repair unit with its derrick extended according to one exemplary embodiment of the present invention.

Referring to FIG. 1, a retractable, self-contained mobile repair unit 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a first transducer 46, a monitor 48, and retractable feet 50.

Figure 2:
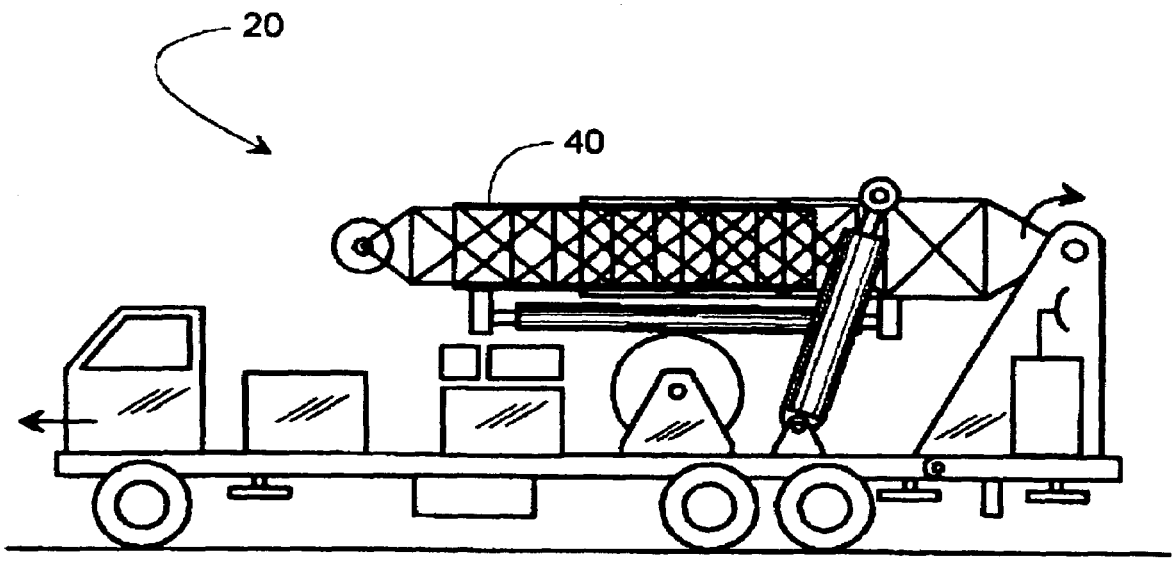
FIG. 2 is a side view of the exemplary mobile repair unit with its derrick retracted according to one exemplary embodiment of the present invention.

The engine 26 selectively couples to the wheels 24 and the hoist 36 by way of the transmissions 34 and 32, respectively. The engine 26 also drives the hydraulic pump 28 via the line 29 and the air compressor 30 via the line 31. The compressor 30 powers a pneumatic slip (Not Shown), and pump powers a set of hydraulic tongs (Not Shown). The Pump 28 also powers the cylinders 42 and 44 which respectively extend and pivot the derrick 40 to selectively place the derrick 40 in a working position, as shown in FIG. 1, and in a lowered position, as shown in FIG. 2. In the working position, the derrick 40 is pointed upward, but its longitudinal centerline 54 is angularly offset from vertical as indicated by the angle 56. The angular offset provides the block 38 access to a well bore 58 without interference with the derrick pivot point 60. With the angular offset 56, the derrick framework does not interfere with the typically rapid installation and removal of numerous inner pipe segments (known as an inner pipe string, rods, or tubing 62).

Individual pipe segments (of string 62) and sucker rods are screwed to themselves using hydraulic tongs. The term "hydraulic tongs" used herein and below refer to any hydraulic tool that can screw together two pipes or sucker rods. An example would include those provided by B. J. Hughes company of Houston, Tex. In operation, the pump 28 drives a hydraulic motor (Not Shown) forward and reverse by way of a valve. Conceptually, the motor drives the pinions which turn a wrench element relative to a clamp. The element and clamp engage flats on the mating couplings of a sucker rod or inner pipe string 62 of one conceived embodiment of the invention. However, it is well within the scope of the invention to have rotational jaws or grippers that clamp on to a round pipe (i.e., no flats) similar in concept to a conventional pipe wrench, but with hydraulic clamping. The rotational direction of the motor determines assembly or disassembly of the couplings.

While not explicitly shown in the figures, when installing the inner pipe string segments 62, the pneumatic slip is used to hold the pipe string 62 while the next segment of pipe string 62 is screwed on using tongs. A compressor 30 provides pressurized air through a valve to rapidly clamp and release the slip. A tank helps maintain a constant air pressure. Pressure switch provides monitor 48 (FIG. 3) with a signal that indirectly indicates that rig 20 is in operation.

Figure 3:
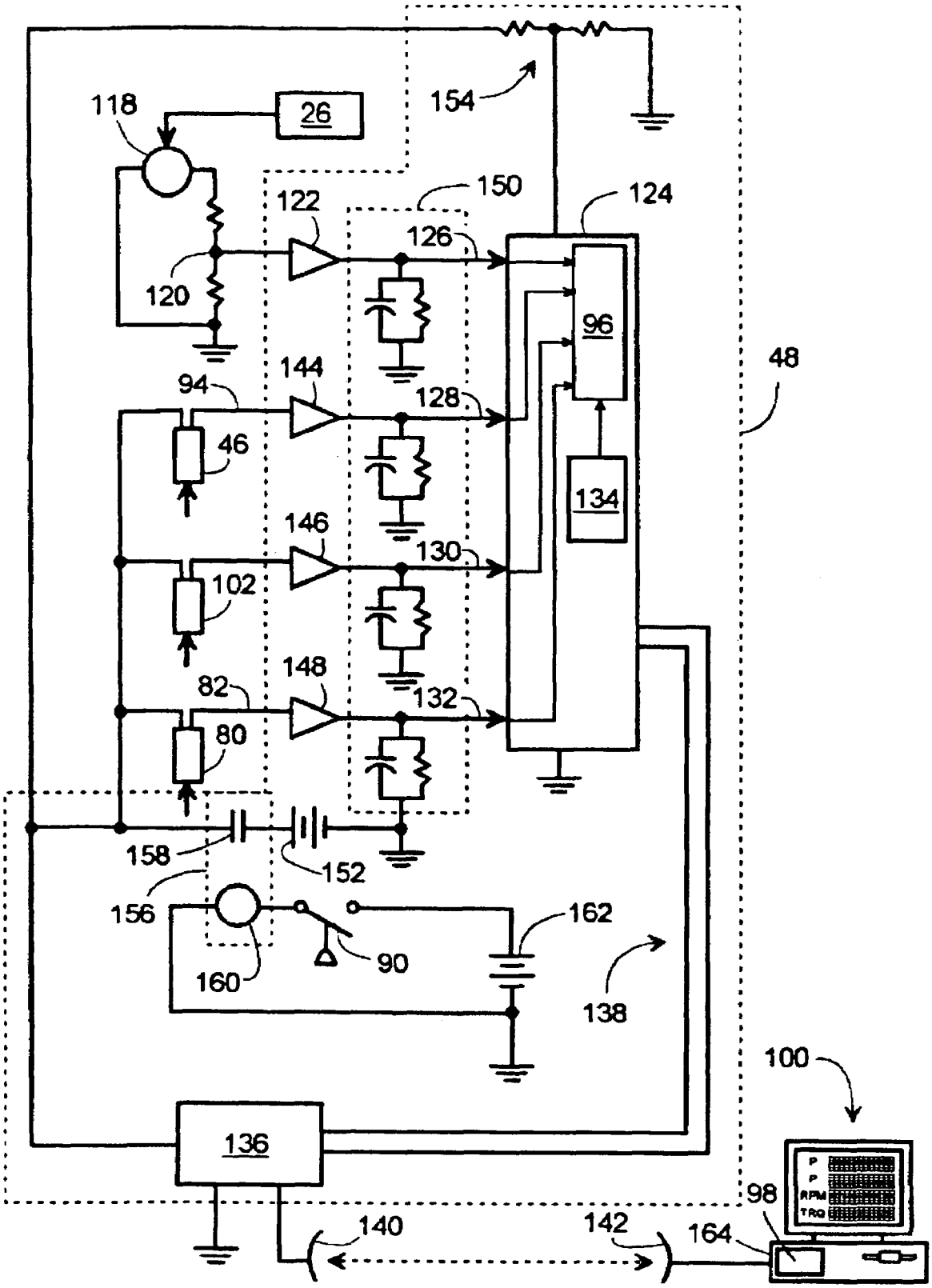
FIG. 3 is an electrical schematic of a monitor circuit according to one exemplary embodiment of the present invention.

Referring back to FIG. 1, weight applied to the block 38 is sensed by way of a hydraulic pad 92 that supports the weight of the derrick 40. The hydraulic pad 92 is basically a piston within a cylinder (alternatively a diaphragm) such as those provided M. D. Totco company of Cedar Park, Tex. Hydraulic pressure in the pad 92 increases with increasing weight on the block 38. In FIG. 3, the first transducer 46 converts the hydraulic pressure to a 0-5 VDC signal 94 that is conveyed to the monitor 48. The monitor 48 converts signal 94 to a digital value, stores it in a memory 96, associates it with a real time stamp, and eventually communicates the data to a remote computer 100 by way of a modem 98, T1 line, WiFi or other device or method for transferring data known to those of ordinary skill in the art.

Figure 4:
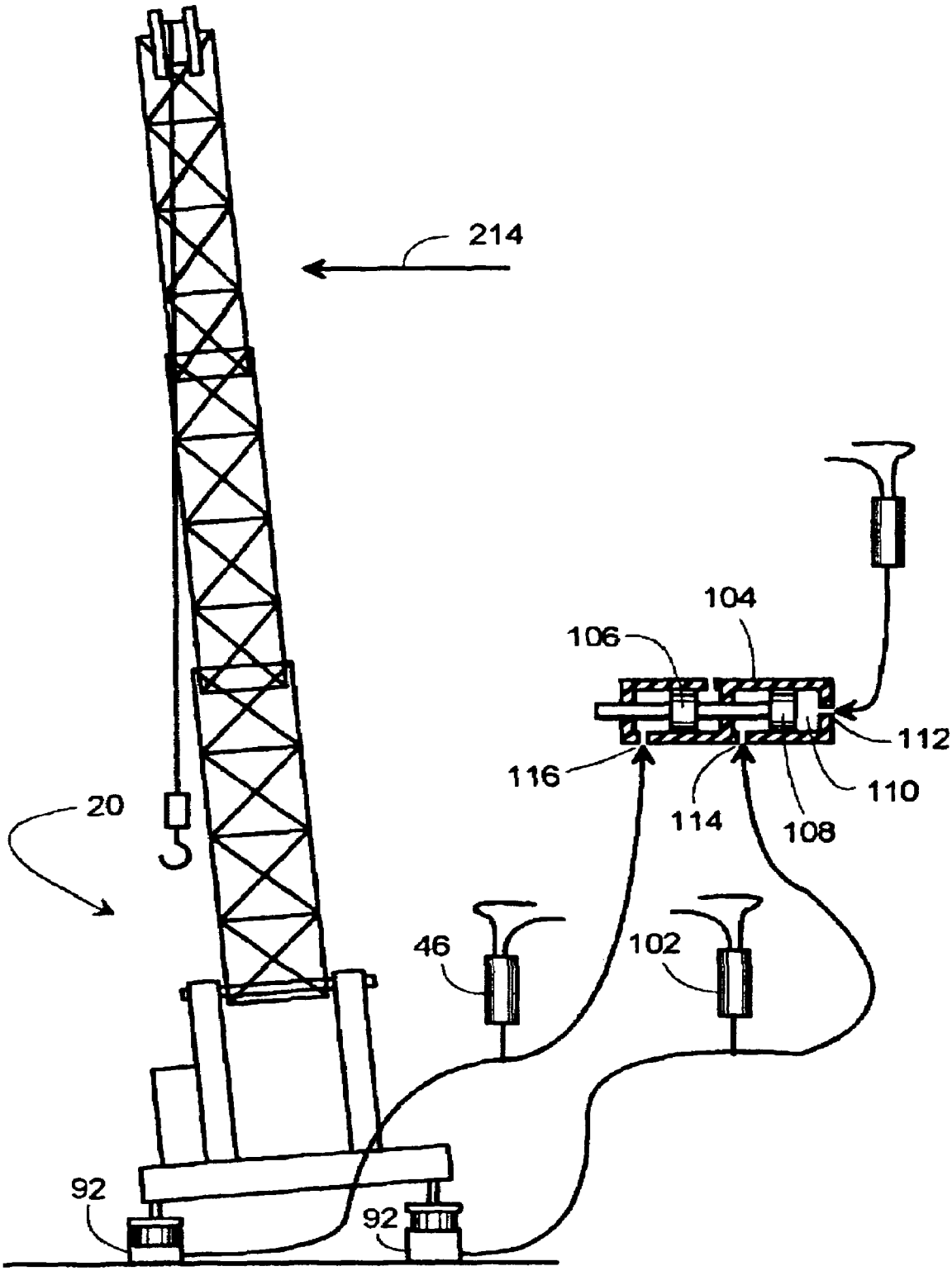
FIG. 4 is an exemplary end view of an imbalanced derrick according to one exemplary embodiment of the present invention.

In the embodiment of FIG. 4, two pads 92 associated with two transducers 46 and 102 are used. An integrator 104 separates the pads 92 hydraulically. The rod side of the pistons 106 and 108 each have a pressure exposed area that is half the full face area of the piston 108. Thus, the chamber 110 develops a pressure that is an average of the pressures in the pads 92. One type of integrator 104 is provided by M. D. Totco company of Cedar Park, Tex. In one embodiment of the present invention, just one transducer 46 is used and it is connected to the port 112. In another embodiment of the present invention, two transducers 46 and 102 are used, with the transducer 102 on the right side of the rig 20 coupled to the port 114 and the transducer 46 on the left side coupled to the port 116. Such an arrangement allows one to identify an imbalance between the two pads 92.

Returning to FIG. 3, transducers 46 and 102 are shown coupled to the monitor 48. The transducer 46 indicates the pressure on the left pad 92 and the transducer 102 indicates the pressure on the right pad 92. A generator 118 driven by the engine 26 provides an output voltage proportional to the engine speed. This output voltage is applied across a dual-resistor voltage divider to provide a 0-5 VDC signal at point 120 and then passes through an amplifier 122. A generator 118 represents just one of many various tachometers that provide a feedback signal proportional to the engine speed. Another example of a tachometer would be to have engine 26 drive an alternator and measure its frequency. The transducer 80 provides a signal proportional to the pressure of hydraulic pump 28, and thus proportional to the torque of the tongs.

A telephone accessible circuit 124, referred to as a "POCKET LOGGER" by Pace Scientific, Inc. of Charlotte, N.C., includes four input channels 126, 128, 130 and 132; a memory 96 and a clock 134. The circuit 124 periodically samples inputs 126, 128, 130 and 132 at a user selectable sampling rate; digitizes the readings; stores the digitized values; and stores the time of day that the inputs were sampled. It should be appreciated by those skilled in the art that with the appropriate circuit, any number of inputs can be sampled and the data could be transmitted instantaneously upon receipt.

An supervisor at a computer 100 remote from the work site at which the service rig 20 is operating accesses the data stored in the circuit 124 by way of a PC-based modem 98 and a cellular phone 136. The phone 136 reads the data stored in the circuit 124 via the lines 138 (RJ11 telephone industry standard) and transmits the data to the modem 98 by way of antennas 140 and 142. In an alternative embodiment the data is transmitted by way of a cable modem or WiFi system (Not Shown). In one exemplary embodiment of the present invention, the phone 136 includes a CELLULAR CONNECTION.™. provided by Motorola Incorporated of Schaumburg, Ill. (a model S1936C for Series II cellular transceivers and a model S1688E for older cellular transceivers).

Figure 5:
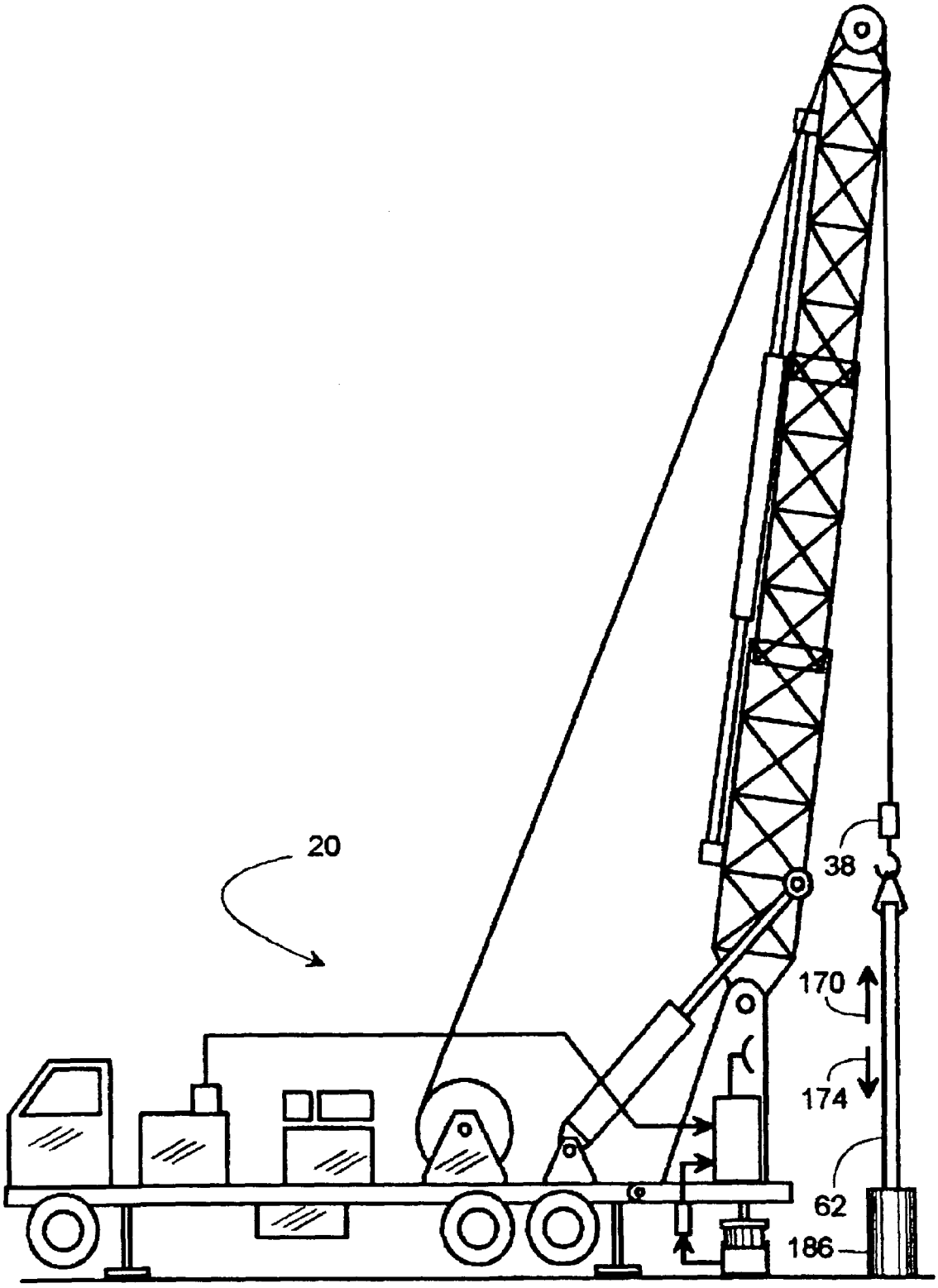
FIG. 5 illustrates the raising and lowering of an inner tubing string with an exemplary mobile repair unit according to one exemplary embodiment of the present invention.

Some details worth noting about the monitor 48 is that its access by way of a modem makes the monitor 48 relatively inaccessible to the crew at the job site itself. However the system can be easily modified to allow the crew the capability to edit or amend the data being transferred. The amplifiers 122, 144, 146 and 148 condition their input signals to provide corresponding inputs 126, 128, 130 and 132 having an appropriate power and amplitude range. Sufficient power is needed for RC circuits 150 which briefly (e.g., 2-10 seconds) sustain the amplitude of inputs 126, 128, 130 and 132 even after the outputs from transducers 46, 102 and 80 and the output of the generator 118 drop off. This ensures the capturing of brief spikes without having to sample and store an excessive amount of data. A DC power supply 152 provides a clean and precise excitation voltage to the transducers 46, 102 and 80; and also supplies the circuit 124 with an appropriate voltage by way of a voltage divider 154. A pressure switch 90 enables the power supply 152 by way of the relay 156, whose contacts 158 are closed by the coil 160 being energized by the battery 162. FIG. 5 presents an exemplary display representing a service rig 20 lowering an inner pipe string 62 as represented by arrow 174 of FIG. 5.

Processes of exemplary embodiments of the present invention will now be discussed with reference to FIGS. 8, 11, and 13. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 6:
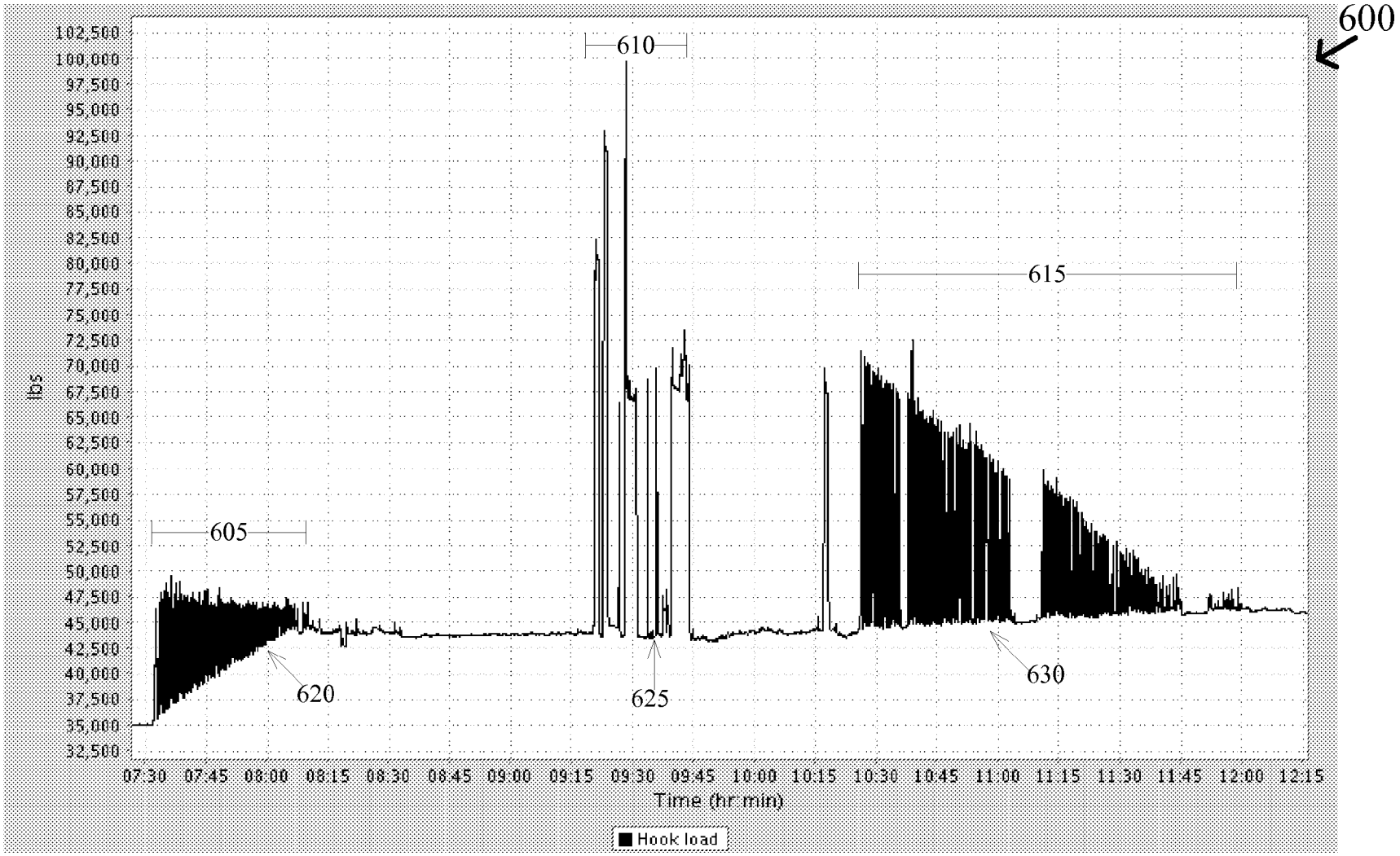
FIGS. 6 and 7 are exemplary displays of rig load data charts according to one exemplary embodiment of the present invention.
Figure 7:
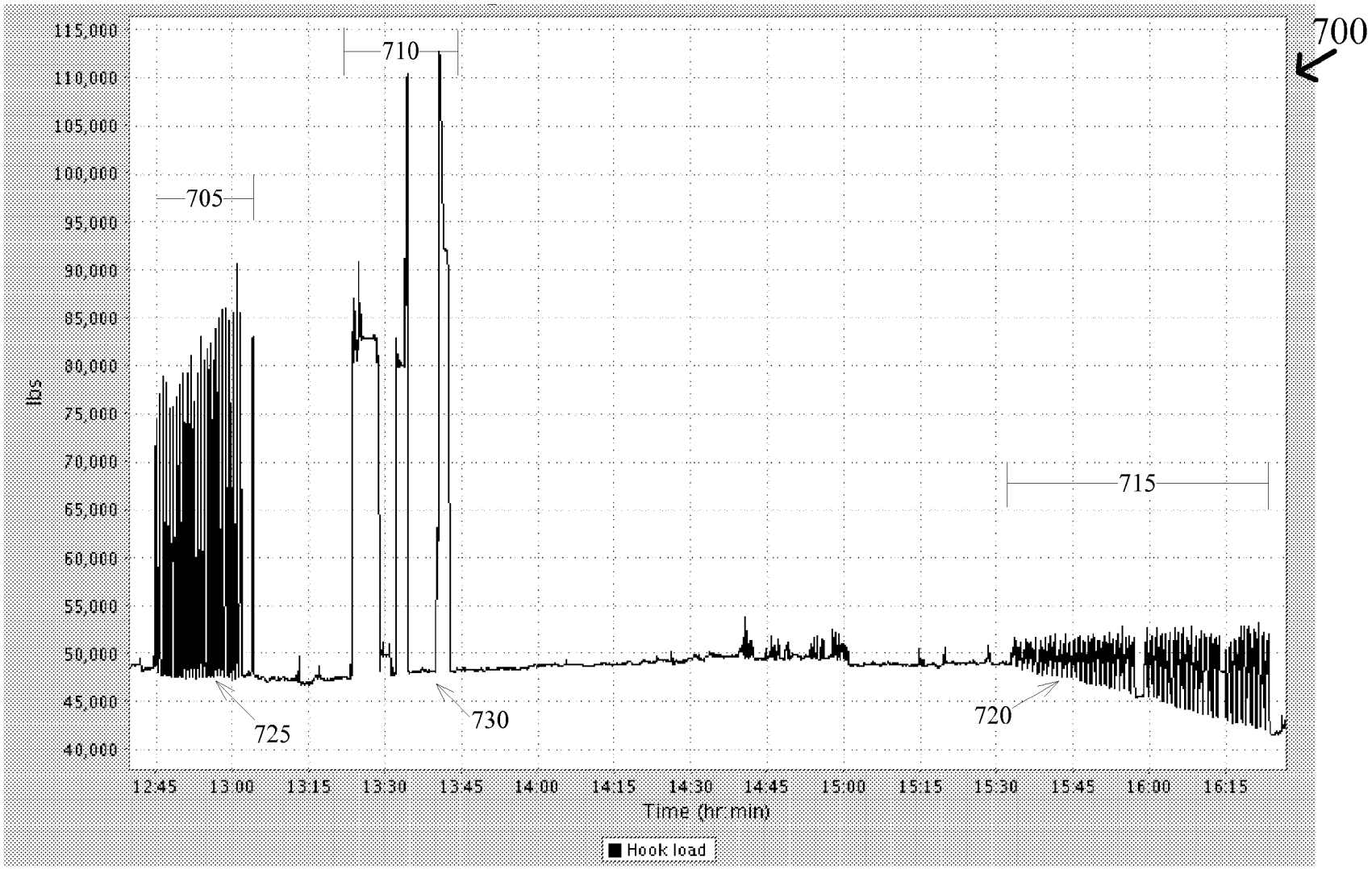

Turning now to FIGS. 6 and 7, an illustration of exemplary displays 600 and 700 of rig load data charts in accordance with an exemplary embodiment of the present invention are shown and described within the exemplary operating environment of FIGS. 3 and 5. Now referring to FIGS. 3, 5, 6, and 7, the exemplary display 600 includes a rig load data chart 600. The X-axis of the rig load data chart 600 represents time and the Y-axis represents rig load in pounds. Rig load can be measured at several places on the rig 20. For instance, rig load can be measured on each individual rig pad 92, on a transducer or sensor on the output side of the integrator on the pad weight indicator (Not Shown), on a strain gage placed on the mast of the rig 20 to measure compression in a derrick leg, on a dead line, line sensor, line diaphragm, sending diaphragm or cylinder (Not Shown). The rig load displayed in the rig load charts is based on the total weight on the pads 92, not the load on the hook 38.

FIG. 6 presents the general patterns for rig load data curves during activities for pulling rods and tubing out of a hole. The exemplary rig load chart 600 includes three activities 605-615. In the first activity 605, the rig 20 is pulling rods out of the well 58. During this activity, the baseline 620 of the rig load is increasing. In one exemplary embodiment, activities accomplished by the service rig 20 and other third party crews and vehicles include, but are not limited to, activity is selected from a group consisting of rigging up a service rig, pulling rods, laying down rods, pulling tubing, laying down tubing, picking up tubing, running tubing, picking up rods, running rods, rigging down the work-over rig, rigging up an auxiliary service unit, rigging down an auxiliary service unit, long-stroke, cut paraffin, nipple up a blow out preventer, nipple down a blow out preventer, fishing, jarring, swabbing, flow-back, drilling, clean out, well control activities, killing a well, circulating fluid within a well, unseating pumps, setting a release tubing anchor, releasing a tubing anchor, setting a packer, releasing a packer, picking up drill collars, laying down drill collars, picking up tools, laying down tools, rigging up third party servicing equipment, well stimulation, cementing, logging, perforating, inspecting the well, and traveling to the well site. The rig 20 is hanging rods 62 in the basket (Not Shown) of the rig 20. Since the rig is on pads 92, each stand of rods 62 makes the derrick 40 appear to have an increased rig load as presented in the baseline 620. The upper level of the weight data for the first activity 605 is substantially consistent.

In the third activity, the rig 20 is pulling tubing 62 out of the well 58. Since tubing is not hung, but is instead racked or stacked on the ground, the tubing pull does not exhibit the increasing baseline 630 like in the first activity 605. Each joint of tubing is pulled and stacked so the mast looses the weight of each stand after it has been pulled out of the well 58. The upper level of the rig load data for the third activity 615 is steadily decreasing. This is caused because after each stand of tubing 62 is removed, the rig load of the next stand is less.

The second activity 610 represents the unseating of the tubing anchor catcher ("TAC"). Unseating of the TAC typically occurs between pulling rods out of a well 58 and pulling tubing out of the well 58. This activity 610, typically displays data on the rig load chart 600 that includes a baseline rig load 625 that is substantially constant and upper level rig loads that are random in nature and do not show a steady increase of decline.

FIG. 7 presents the general patterns for exemplary rig load data curves during activities for inserting rods and tubing into a well 58. The exemplary rig load chart 700 includes three activities 705-715. In the first activity 705, the rig 20 is inserting tubing 62 into the well 58. During this activity, the baseline 725 of the rig load is substantially flat because the tubing 62 was stacked on the ground. The upper level of the rig load data for the first activity 705 is increasing steadily because the addition of each successive stand of tubing 62 being inserted into the well 58 makes the entire weight being born by the pads 92 increase.

In the third activity, the rig 20 is inserting rods 62 into the well 58. Since the rods 62 were hanging in the derrick 40, each stand of rods 62 inserted into the well 58 reduces the total weight on the pads 92 thereby causing the baseline 720 to steadily decline. In addition, when inserting rods 62 into the well, the upper level of the rig load data for the third activity 715 is substantially constant.

The second activity 710 represents setting the TAC. Setting the TAC typically occurs between inserting tubing into the well 58 and inserting rods into the well 58. This activity 710, typically displays data on the rig load chart 700 that includes a baseline rig load 730 that is substantially constant and upper level rig loads that are random in nature and do not show a steady increase of decline.

Figure 8:
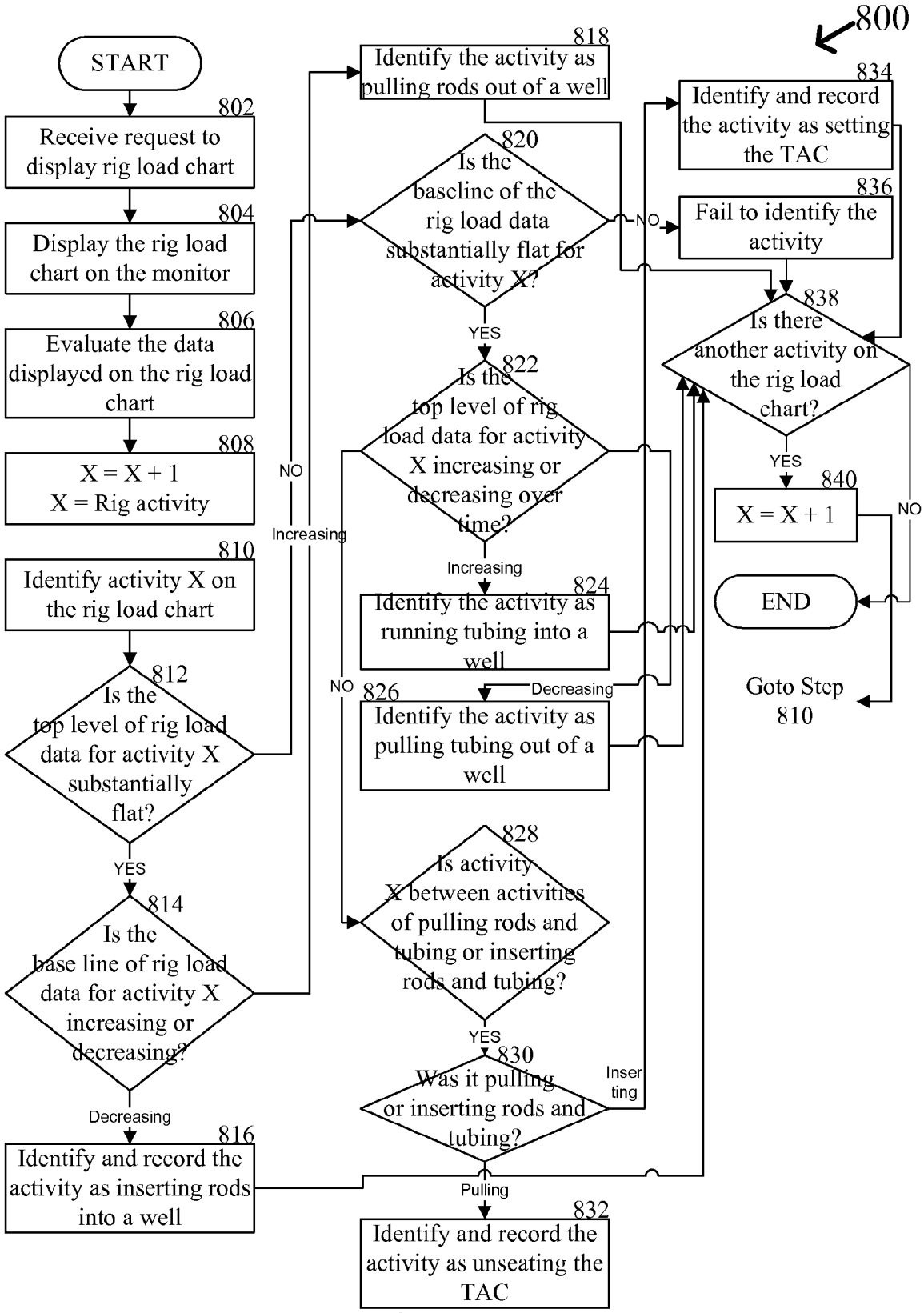
FIG. 8 is a flowchart of an exemplary process for identifying an activity based on an evaluation of the rig load chart according to one exemplary embodiment of the present invention.

FIG. 8 is a logical flowchart diagram illustrating an exemplary method 800 for identifying an activity of a service rig 20 based on an evaluation of the rig load chart. Referencing FIGS. 1, 3, 5, 6, 7, and 8, the exemplary method 800 begins at the START step and continues to step 802, where a request is received to display the rig load chart 600 on the monitor 48 of the computer 100. In step 804, the rig load chart 600 is displayed on the monitor 48. A rig operator or rig owner, well owner or supervisor (collectively "supervisor") evaluates the data in the data curves of the rig load chart 600 on the monitor 48 in step 806. In an alternative embodiment, the supervisor evaluates the data of the rig load chart 600 in hard-copy form printed out by a printer, copier, plotter, or other printing or display device known to those of ordinary skill in the art.

In step 808, counter variable X is set equal to one. In one exemplary embodiment, counter variable X represents an activity completed by a rig 20 during which time the rig load chart 600 was collecting and displaying data on the monitor 48. The supervisor identifies the first activity on the rig load chart 600 in step 810. In one exemplary embodiment, the supervisor identifies an activity by viewing data on the rig load chart 600 and determining how certain portions of the data may likely represent an activity being accomplished by the rig 20.

In step 812, an inquiry is conducted to determine if the upper level of the rig load data on the rig load chart 600 is substantially flat for the first activity. In FIG. 6, the first activity 605 has an upper level of rig load data that is substantially flat (the load in pounds is substantially the same). If the upper level of the rig load data is not substantially flat for the first activity, the "NO" branch is followed to step 820. Otherwise the "YES" branch is followed to step 814. In step 814, an inquiry is conducted to determine if the baseline of the rig load data on the rig load chart 600 is increasing or decreasing for the first activity 605. Returning to the example in FIG. 6, the baseline 620 for the first activity 605 is increasing as time progresses. If the baseline 620 is decreasing, the "Decreasing" branch is followed to step 816, where the supervisor identifies and records the activity as inserting rods into a well 58. FIG. 7 provides an example of a decreasing base line 720 for the third activity 715. On the other hand, if the baseline 620 is increasing, as it is in the first activity 605 of FIG. 6, the "Increasing" branch is followed to step 818, where the supervisor identifies the activity as pulling rods out of a well 58 and records the activity in the computer 100. The process then continues from step 816 or 818 to step 838.

In step 820, an inquiry is conducted to determine if the baseline for the rig load data on the rig load chart 600 is substantially flat for the first activity. In FIG. 6, the baseline 625 for the third activity 615 is substantially flat. In FIG. 7, the baseline 725 for the first activity 705 is also substantially flat. If the baseline 625 for the rig load data is not substantially flat, the "NO" branch is followed to step 836, where the activity is not identified. Otherwise, the "YES" branch is followed to step 822.

In step 822, an inquiry is conducted to determine if the upper level of the rig load data for the first activity is increasing or decreasing over time. As seen in FIG. 6, the third activity 615 has an upper level of rig load data that is decreasing over time. On the other hand, in FIG. 7, the first activity 705 has an upper level of rig load data that is increasing over time. In addition, the second activity 610, 710 in both FIGS. 6 and 7 have an upper level of rig load data that is randomly increasing and decreasing. If the upper level of the rig load data is increasing, the "Increasing" branch is followed to step 824, where the first activity is identified as running tubing 62 into a well 58 and recorded in the computer 100. If, on the other hand, the upper level of the rig load data is decreasing, the "Decreasing" branch is followed to step 826, where the first activity is identified as pulling tubing 62 out of a well 58 and recorded in the computer 100. The process continues from step 824 or 826 to step 838.

If the upper level of the rig load data on the rig load chart 600 is neither substantially increasing nor decreasing, the "NO" branch is followed to step 828. In step 828, an inquiry is conducted to determine if the first activity is positioned between activities for pulling rods and tubing or inserting rods and tubing. As can be seen in FIG. 6, the second activity 610, has a substantially flat baseline, an upper level of data that is neither increasing nor decreasing (it is mainly random) and it is positioned between the first activity 605 of pulling rods 62 out of a well 58 and the third activity 615 of pulling tubing 62 out of the well 58. If it is not between those activities, the "NO" branch is followed to step 836, where the activity is not identified. Otherwise, the "YES" branch is followed to step 830.

In step 830, an inquiry is conducted to determine if the first activity is between a pair of pulling or insertion activities. If the first activity is between activities of the rods and tubing being pulled, the "Pulling" branch is followed to step 832, where the activity is identified as unseating the TAC and recorded in the computer 100. The process then continues from step 832 to step 838. If the first activity is between activities of the rods and tubing being inserted into the well 58, the "Inserting" branch is followed to step 834, where the supervisor identifies the activity as setting the TAC and records it in the computer 100. The process then continues to step 838.

In step 838, an inquiry is conducted to determine if there is another activity to evaluate on the rig load chart 600. If so, the "YES" branch is followed to step 840, where the counter variable X is incremented by one. The process then returns from step 840 to step 810. On the other hand, if the rig load chart 600 does not have any additional activities, the "NO" branch is followed to the END step.

Figure 9:
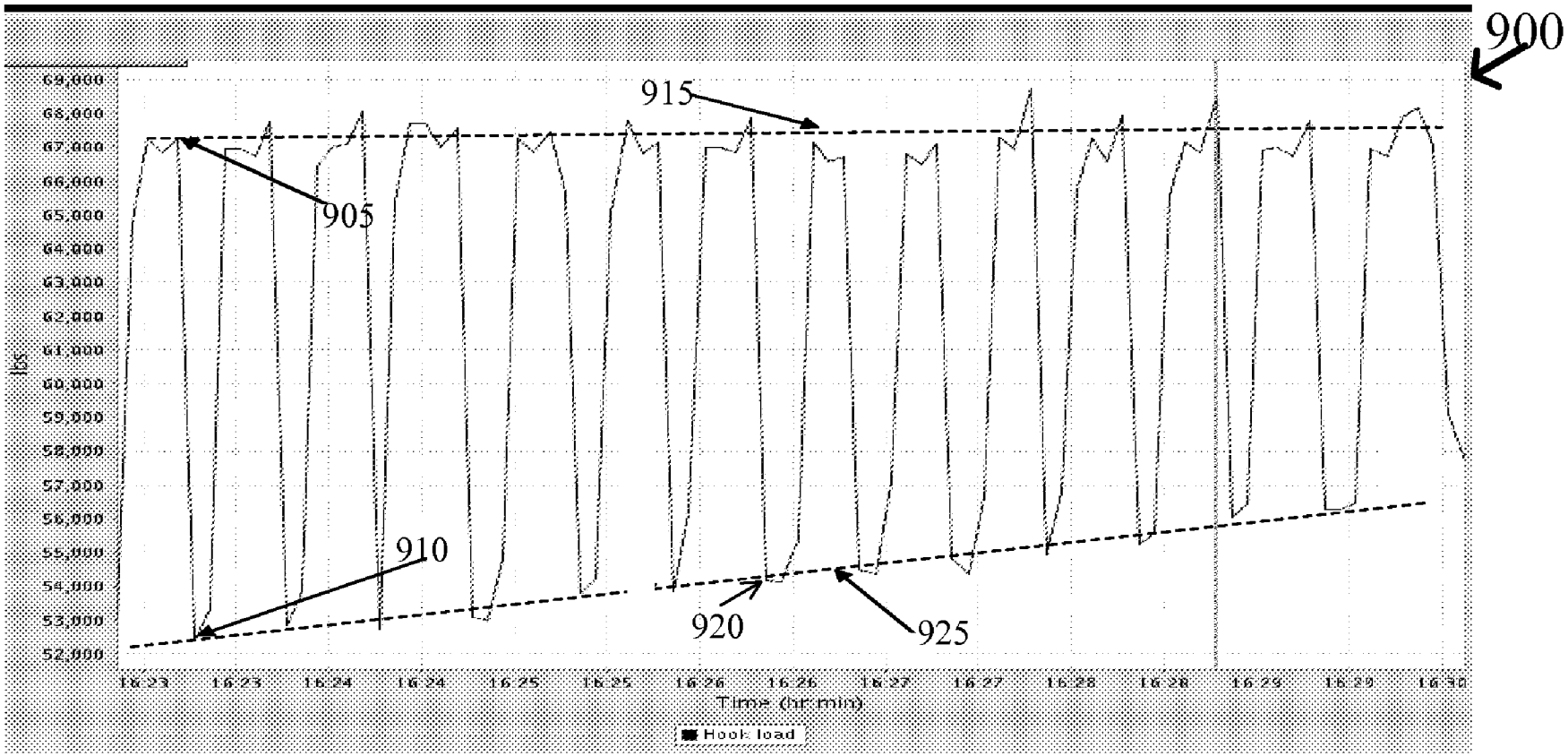
FIGS. 9 and 10 are exemplary displays of rig load charts for determining hook load on a mobile repair unit according to one exemplary embodiment of the present invention.
Figure 10:
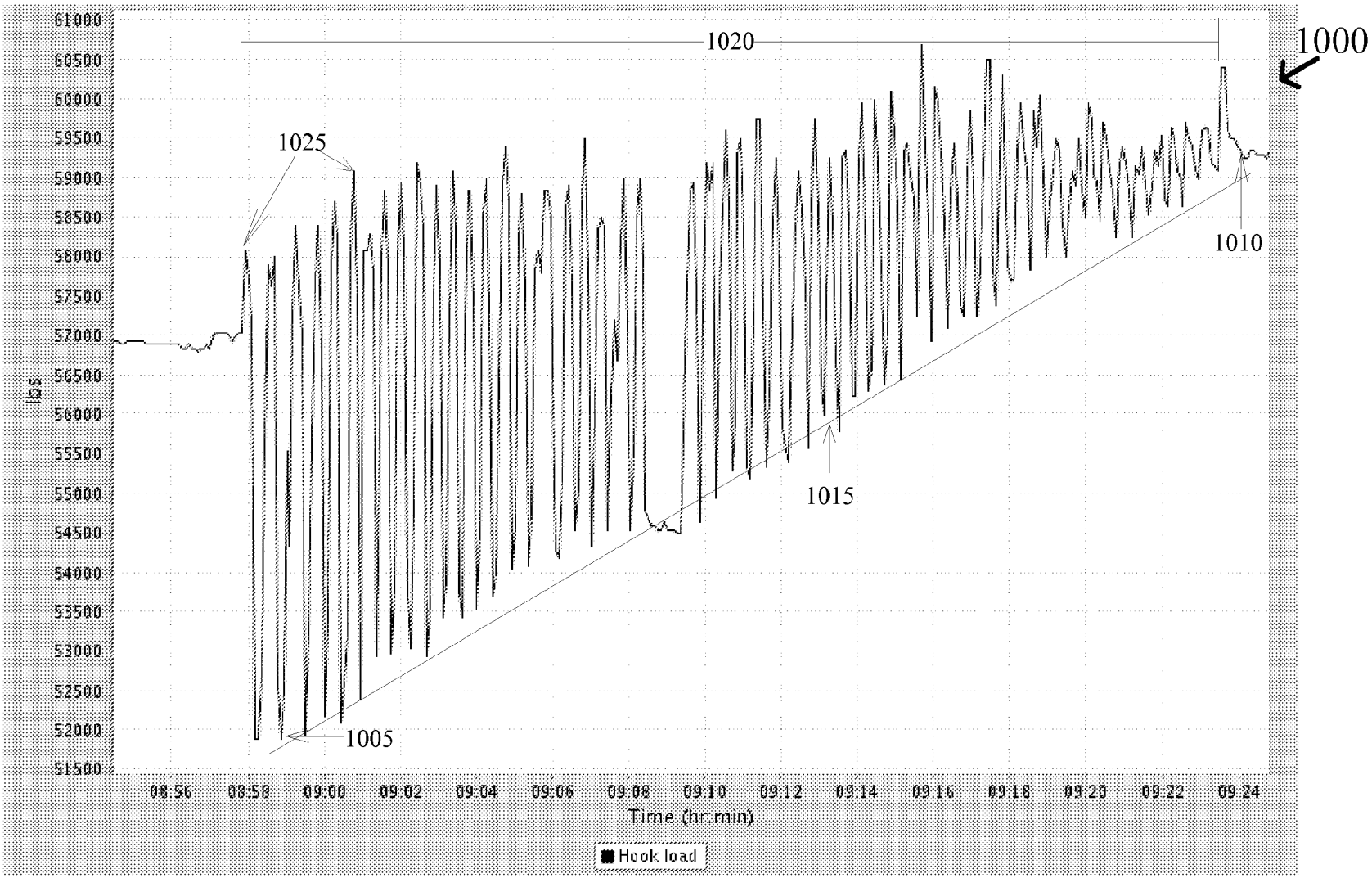

Turning now to FIGS. 9 and 10, an illustration of exemplary displays 900 and 1000 of rig load data charts in accordance with an exemplary embodiment of the present invention are shown and described within the exemplary operating environment of FIGS. 3 and 5. Now referring to FIGS. 3, 5, 9, and 10, the exemplary display 900 includes a rig load data chart 900 of rig load data while rods 62 are being pulled out of the well 58. The first data point 905 and the third data point 915 represent the rig load on the pad 92 and typically includes the hook load, a portion of the weight of the rig 20, and the load of the rods 62 hanging on the derrick 40.

When the rods 62 are resting on the rod elevators on the wellhead (Not Shown) during the rod pull, the hook load is substantially zero, or nulled because in one exemplary embodiment the operator nulls or offsets the empty rig weight so that the chart will read substantially near zero when the rig is not bearing rod or tubing loads. This time in the rod pull provides the baseline 925 for the rig load of this activity and is generally represented by the trough portion of the data, such as the second data point 910 and the fourth data point 920. These data points 910, 920 typically include a portion of the weight of the rig 20 and the load of the rods 62 hanging on the derrick 40. Thus the hook load can be calculated by subtracting the second data point 910 from the first data point 905 or the fourth data point 920 from the third data point 915.

The exemplary display 1000 of FIG. 10 includes a rig load data chart 1000 of rig load data while rods 62 are being pulled out of the well 58. The data displayed on the chart 1000 illustrates a rig 20 pulling rods 62 out of the well 58 and hanging them in the derrick 40. As can be seen in FIG. 10, the baseline 1015 of the rig load data is steadily increasing as the weight of each rod 62 is pulled out of the well 58. The number of peaks of data can be counted to determine the number of stands of rods 62 that have been pulled from the well 58. In this exemplary embodiment, the rig load chart 1000 includes 52 peaks of data representing 52 stands of rods 62 pulled from the well 58. The additional load carried by the rig 20 can also be calculated by taking the lowest baseline data point 1005 and subtracting that from the highest baseline data point 1010, which in this example is approximately 59,250 pounds minus 52,000 pounds or 7,250 pounds of rods 62 pulled from the well 58.

Figure 11:
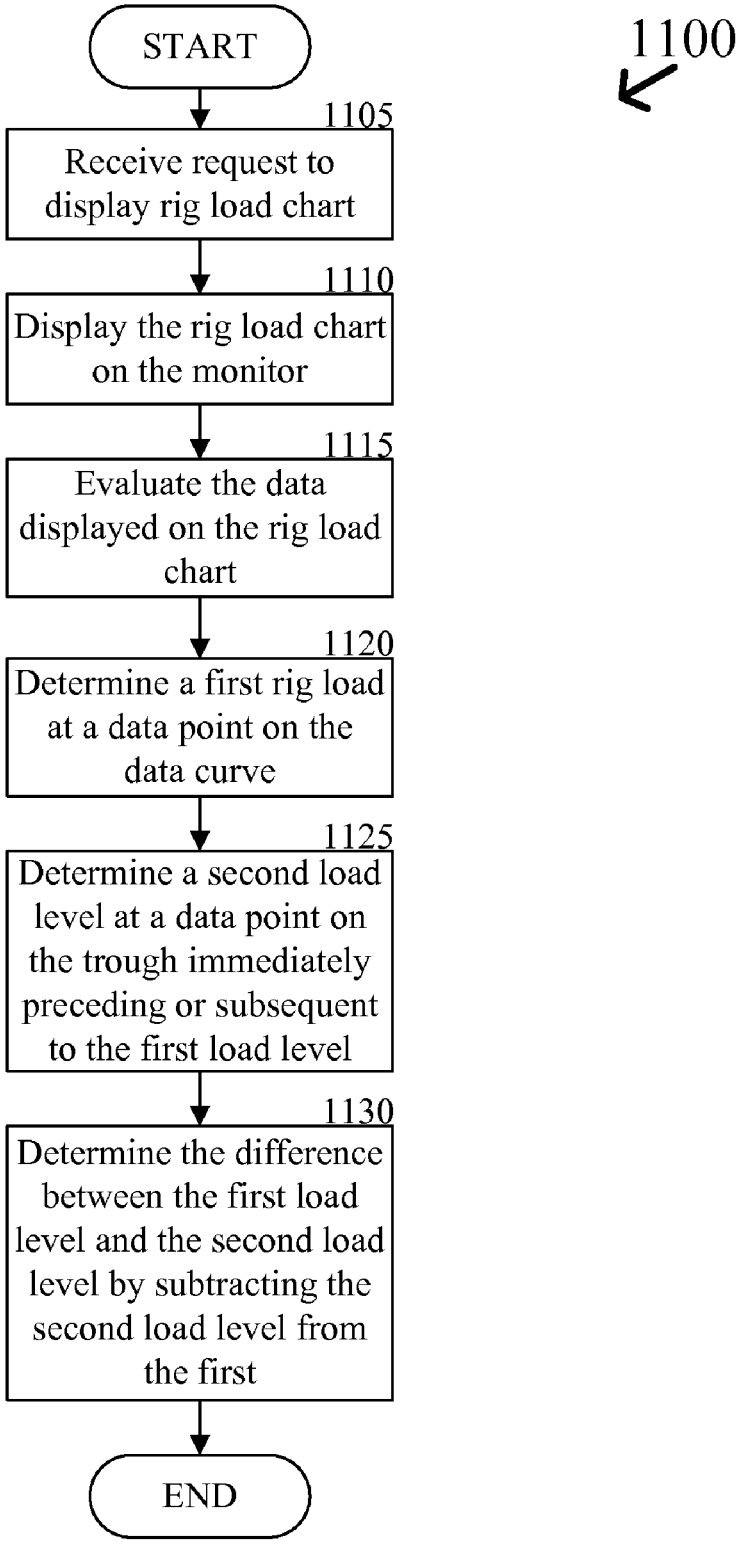
FIG. 11 is a flowchart of an exemplary process for measuring hook load on a mobile repair unit by evaluating the exemplary electronic display of readings from sensors on the mobile service rig according to one exemplary embodiment of the present invention.

FIG. 11 is a logical flowchart diagram illustrating an exemplary method 1100 for measuring hook load on a service rig 20 by evaluating the rig load chart 900. Referencing FIGS. 1, 3, 5, 9, and 11, the exemplary method 1100 begins at the START step and continues to step 1105, where a request is received to display the rig load chart 900 on the monitor 48 at the computer 100. In step 1110, the rig load chart 900 is displayed on the monitor 48. A supervisor evaluates the data in the data curves of the rig load chart 900 on the monitor 48 in step 1115. In an alternative embodiment, the supervisor evaluates the data of the rig load chart 900 in hard-copy form printed out by a printer, copier, plotter, or other printing or display device known to those of 1ordinary skill in the art.

In step 1120, the supervisor determines the first rig load at a data point on a data curve. In FIG. 9, the first rig load can be represented by the first data point 905 or the third data point 915 on the rig load chart 900. The supervisor determines a second load level at a data point on the trough of the data curve that is immediately preceding or subsequent to the selected first load level. Returning to FIG. 9, the second load level can be represented by the second data point 910 or the fourth data point 920 on the rig load chart 900. In step 930, the supervisor determines the difference between the first load level 905 and the second load level 910 by subtracting the second load level 910 from the first load level 905. In FIG. 9, the hook load for the first 905 and second 910 data points is approximately 14,500 pounds, while the hook load for the third 915 and fourth 920 data points is approximately 13,000 pounds. The process continues from step 1130 to the END step.

Figure 12:
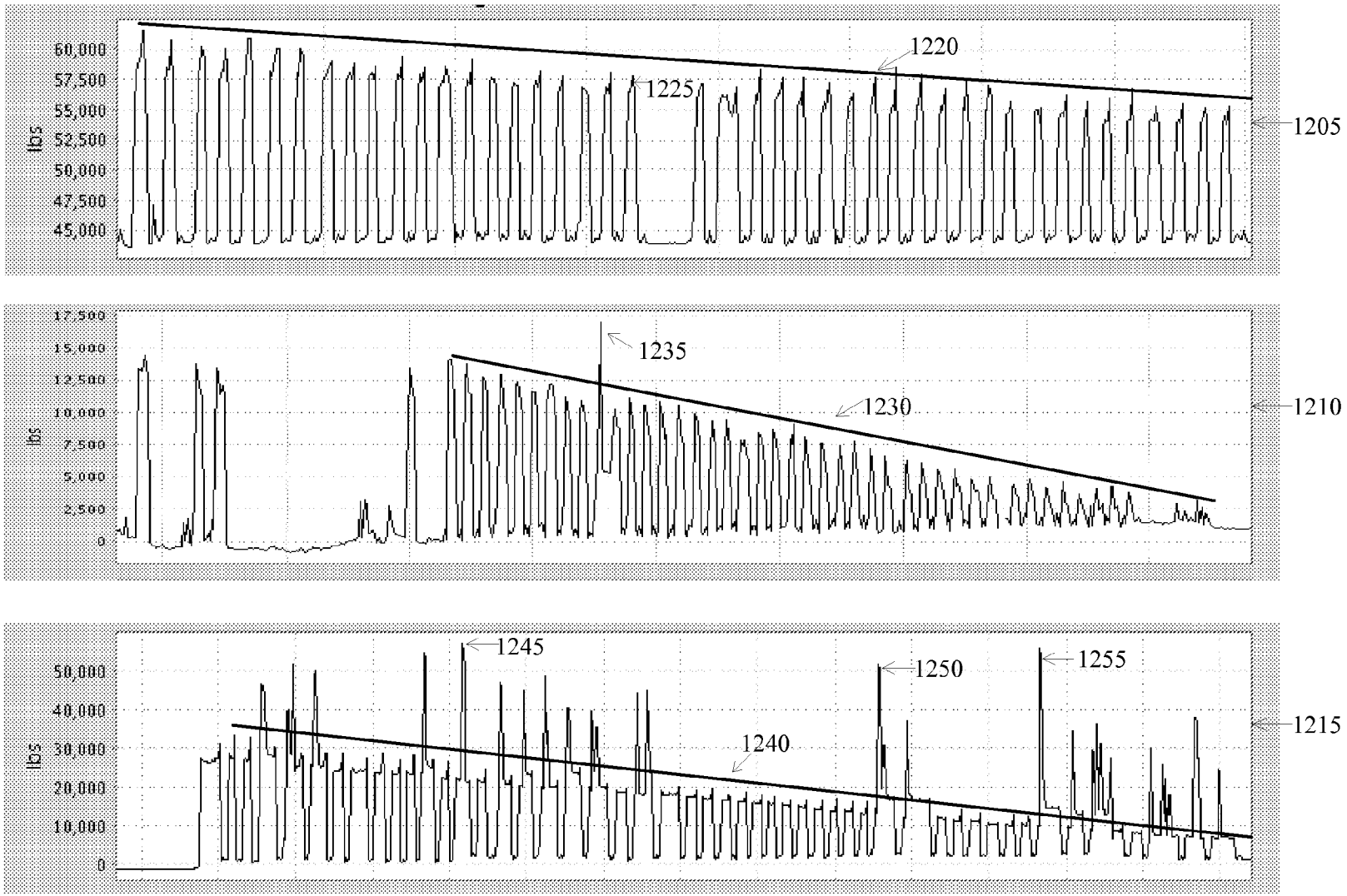
FIG. 12 is a comparative display of exemplary rig load charts for evaluating well bore conditions according to one exemplary embodiment of the present invention.

FIG. 12, illustrates a comparative display of three exemplary rig load charts 1205, 1210, 1215 of rig load data charts for evaluating well bore conditions while putting tubing 62 out of the well 58 according to one exemplary embodiment of the present invention. Now referring to FIGS. 3, 5, and 12, the exemplary display on the monitor 48 includes a first rig load data chart 1205. The first rig load data chart 1205 displays rig load data for a normal or "trouble-free" pull of tubing 62 out of the well 58. The baseline of the rig load data is substantially constant and the upper level of the rig load data is decreasing at a substantially steady pace over time. When an average load level decline 1220 line is positioned along the rig load chart 1205 for the upper level loads during the tubing pull, none of the rig load data is substantially above the average load level decline 1220.

The second rig load data chart 1210 also displays rig load data during the removal of tubing 62 from the well 58. By positioning an average load level decline 1230 line on the second rig load chart 1210 it can be determined that there is a single area 1235 where rig load data was substantially above the average load level decline. When there is a single area of the data representing a load level that is abnormal, as is the data at 1235, the problem is typically diagnosed as a bad or narrow spot in the well 58. To determine the position of the bad or narrow spot in the well 58, the supervisor can count the peaks of data after the abnormal peak 1235 on the monitor 48 until all the tubing has been removed from the well 58 and multiply that number by the length of each stand of tubing 62 to determine the depth of the bad or narrow spot in the well 58.

The third rig load data chart 1215 also displays rig load data during the removal of tubing 62 from the well 58. The chart 1215 further includes an average load level decline 1240 line. A view of the rig load data on the monitor 48 at the computer 100 alerts the supervisor that there are several data points that are substantially above the average load level decline 1240, including data points 1245, 1250, and 1255. When the abnormal spikes in rig load data occur several times at random intervals, it is unlikely that the well 58 would have this many tight spots in the casing 186. Instead, the activity causing this type of data typically occurs when the TAC does not properly release and the rig operator is dragging it out of the well 58 with the dogs of the TAC not fully retracted.

Figure 14:
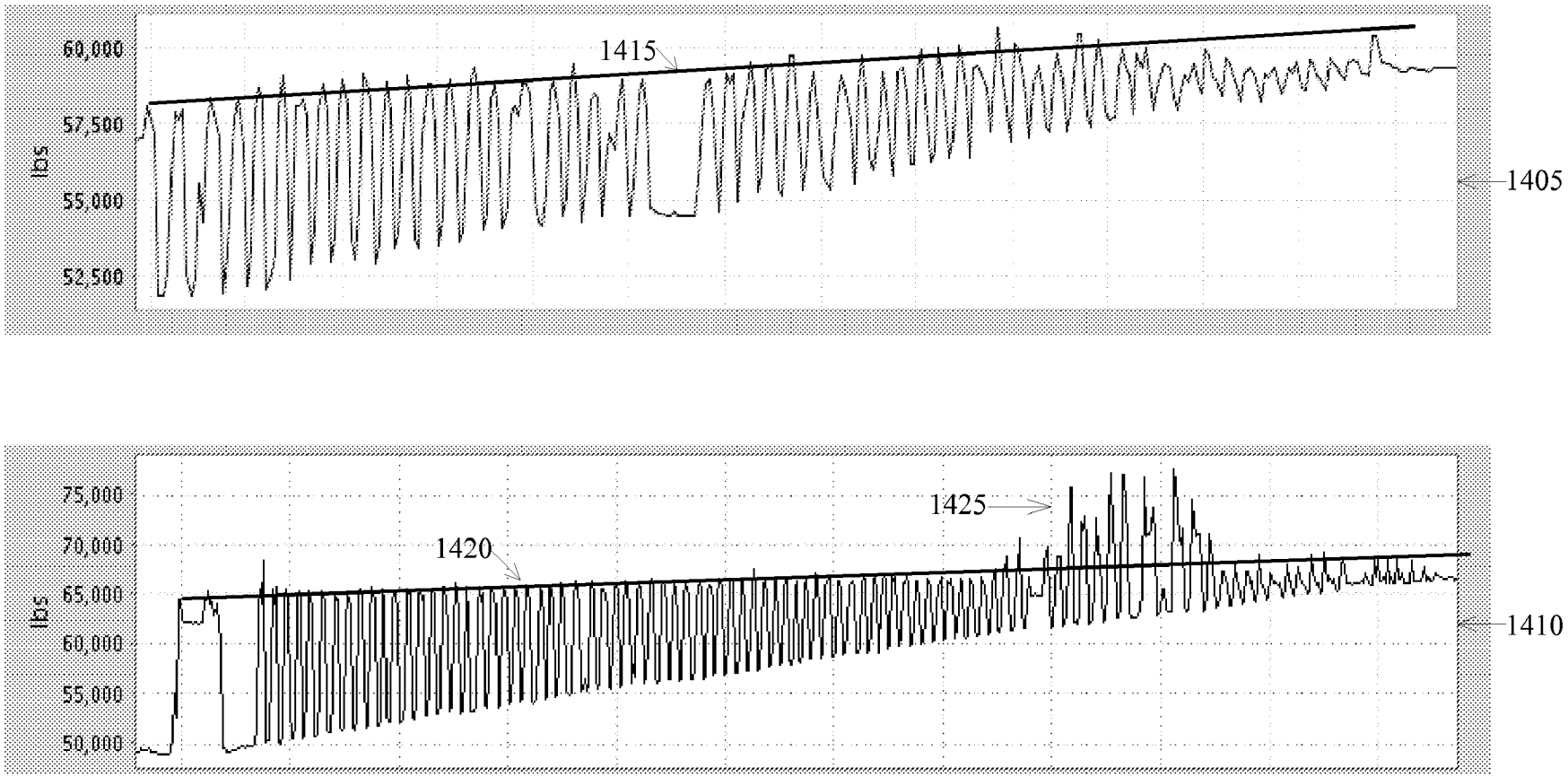
FIG. 14 is a comparative display of exemplary rig load charts for evaluating well bore condition according to one exemplary embodiment of the present invention.

FIG. 14, illustrates a comparative display on the monitor 48 of two exemplary rig load charts 1405, 1410 of rig load data for evaluating well bore conditions while pulling rods out of the well 58 according to one exemplary embodiment of the present invention. Now referring to FIGS. 3, 5, and 14, the exemplary display includes a first rig load data chart 1405. The first rig load data chart 1405 displays rig load data for a normal or "trouble-free" pull of rods 62 out of the well 58. The baseline of the rig load data is steadily increasing and the upper level of the rig load data is increasing at a slow but steady rate because of the buoyancy effect in the well system, because rods weigh less in the well fluid due to displacement. When an average load level increase 1415 line is positioned along the rig load chart 1405 for the upper level loads during the rod pull, none of the rig load data is substantially above the average load level increase 1415.

The second rig load data chart 1410 also displays rig load data during the removal of rods 62 from the well 58. The chart 1410 further includes an average load level increase 1420 line. A view of the rig load data on the monitor 48 of the computer 100 alerts the supervisor that there are several data points that are substantially above the average load level decline 1420, including data points 1425. This rig load data indicates that the rods 62 are dragging in the tubing 186. When the abnormal spikes in rig load data occur in a relatively small area and are tightly bunched, as shown in the second rig load data chart 1410, it is likely that the pump (Not Shown) is being pulled into a paraffin buildup interval within the tubing and the pump is acting as a paraffin swab.

Paraffin is temperature sensitive and typically remains in solution until the oil cools off as it travels from downhole in the well 58 to the surface. At some temperature associated with the geothermal gradient, paraffin drops out and adheres to the tubing 62. The supervisor can determine the location of the paraffin by reviewing rig load data on the monitor 48 and counting the number of peaks of rig load data that occur after the abnormal data caused by the paraffin and multiplying that number by the length of a stand of rods 62.

Figure 13:
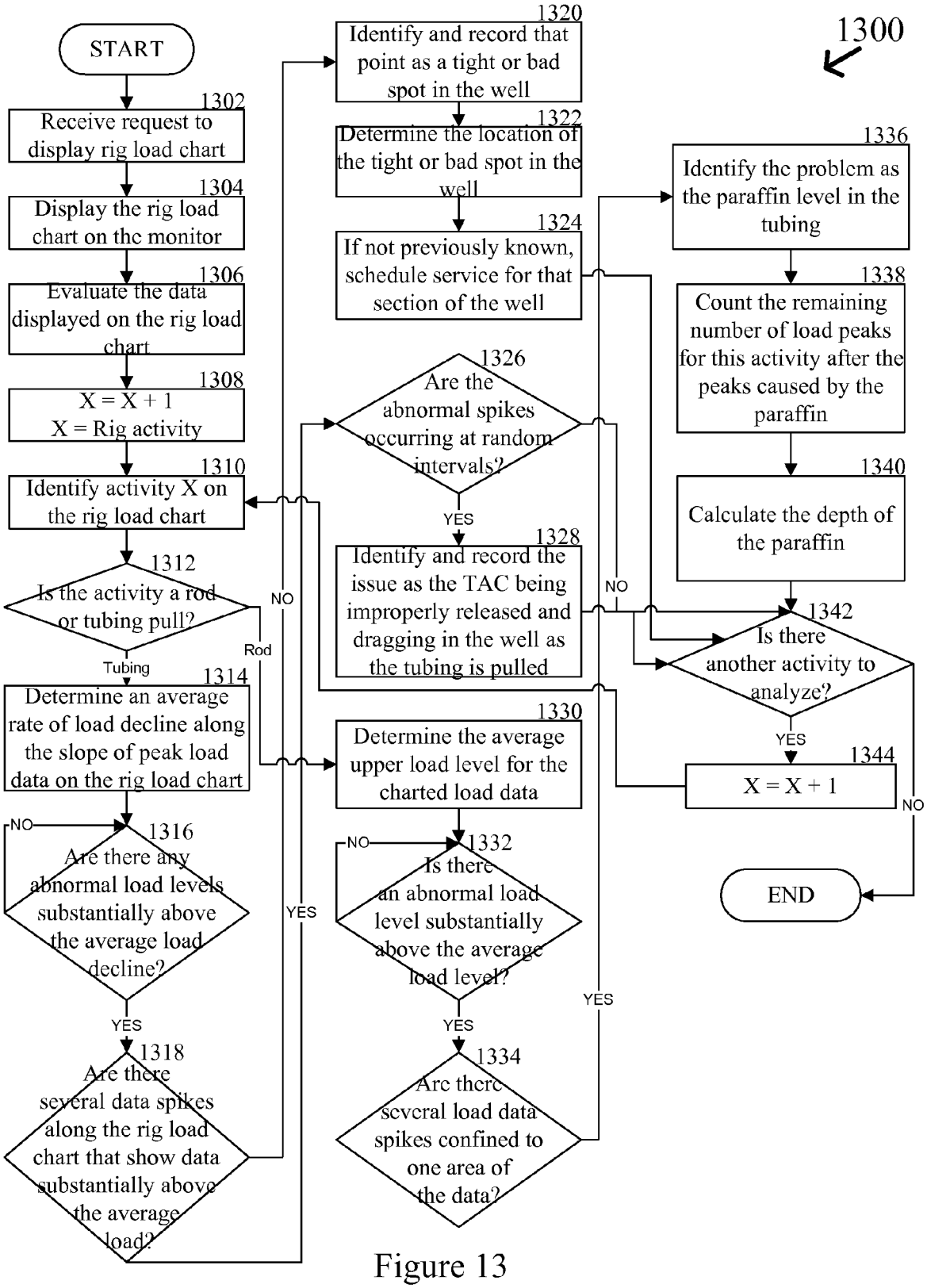
FIG. 13 is a flowchart of an exemplary process for determining well bore conditions by evaluating the exemplary rig load data charts according to one exemplary embodiment of the present invention.

FIG. 13 is a logical flowchart diagram illustrating an exemplary method 1300 for determining well bore conditions by evaluating the exemplary rig load data charts. Referencing FIGS. 1, 3, 5, 12, 13, and 14, the exemplary method 1300 begins at the START step and continues to step 1302, where a request is received to display the rig load chart on the monitor 48 at the computer monitor 100. In step 1304, the rig load chart is displayed on the monitor 48. A supervisor evaluates the data in the data curves of the rig load chart on the monitor 48 at the computer 100 in step 1306. In an alternative embodiment, the supervisor evaluates the data of the rig load chart in hard-copy form printed out by a printer, copier, plotter, or other printing or display device known to those of ordinary skill in the art.

In step 1308, counter variable X is set equal to one. In one exemplary embodiment, counter variable X represents an activity completed by the service rig 20. In step 1310, the supervisor views the monitor 48 and identifies an activity on the rig load chart. In one exemplary embodiment, the supervisor identifies the activity on the chart in the manner described in FIGS. 6-8 hereinabove. In step 1312, an inquiry is conducted to determine if the first activity is the pulling of rods or tubing from a well 58. If tubing is being pulled from the well 58, the "Tubing" branch is followed to step 1314, where the supervisor evaluates the data on the monitor 48 and determines an average rate of load decline along the slope of peak load data on the rig load chart. For example, in FIG. 12, the average rate of load decline is represented by the lines 1220, 1230, and 1240 in rig load charts 1205, 1210, and 1215 respectively. While the exemplary embodiment shows an actual line displayed in the rig load charts 1205-1215, those of ordinary skill in the art will recognize that an operator or supervisor is capable of viewing the load data on the monitor 48 and "eyeballing" where an average load decline line 1220, 1230, 1240 would be without actually having it placed on the chart.

In step 1316, an inquiry is conducted by the supervisor to determine if there are any data points on the chart 1205-1215 that represent abnormal load levels that are substantially above the average load decline 1220, 1230, 1240. If not, the "NO" branch is followed to step 1316 to continue looking for abnormal rig load levels. Otherwise, the "YES" branch is followed to step 1318. In the example of FIG. 12, rig load chart 1210 presents an abnormal load level at data point 1235. In addition, rig load chart 1215 presents abnormal load levels at several data points, including data points designated 1245-1255.

In step 1318, an inquiry is conducted by the supervisor to determine if there are several data spikes above the average load decline. In FIG. 12, rig load chart 1215 presents several data spikes 1245-1250 above the average load decline 1240 while rig load chart 1210 only has a single data spike 1235 above the average load decline 1230 and rig load chart 1205 does not have any data spikes above the average load decline 1220. In one exemplary embodiment, evaluating whether there are several spikes, the supervisor typically evaluates whether several different stands of tubing 62 show higher than normal load levels, not if a single pull of string 62 happens to display multiple data points above the average load decline levels. If there are not several spikes above the average load decline, the "NO" branch is followed to step 1320, where the supervisor identifies the problem as a tight or bad spot in the well 58.

In step 1322, the supervisor determines the location of the tight or bad spot in the well. In one exemplary embodiment, the supervisor evaluates the monitor 48 to determine the location by counting the number of peaks in the data chart 1210 that occur after the abnormally high rig load data spike 1235 until all the tubing is pulled from the well 58. The supervisor then multiplies that number by the length of the tubing 62 being pulled from the well 58 to determine where the tight or bad spot is located. In step 1324, the supervisor records the location of the tight or bad spot in the well 58 and, if not previously identified, schedules service for that section of the well 58.

Returning to step 1318, if there are several data spikes above the average load decline, the "YES" branch is followed to step 1326. In step 1326, an inquiry is conducted by the supervisor to determine if the abnormal load spikes are occurring at random intervals. As shown in the rig load chart 1215 of FIG. 12, the abnormal load spikes 1245-1255 in this exemplary chart 1215 are occurring at random intervals. If the spikes are not occurring at random intervals, the "NO" branch is followed to step 1342. Otherwise, the "YES" branch is followed to step 1328, where the supervisor identifies the problem as the TAC being improperly released and dragging in the well 58 as the tubing 62 is being pulled out and records the problem in the computer 100. The process continues from step 1328 to step 1342.

Returning to step 1312, if the activity is determined by the supervisor to be pulling rods, the "Rod" branch is followed to step 1330 to determine the average upper load level for the charted load data. For example, in FIG. 14, the first rig load chart 1405 has an average upper load level represented by the line 1415, while the second rig load chart 1410 has an average upper load level represented by the line 1420. In step 1332, an inquiry is conducted to determine if there is any rig load data at a level substantially above the average load level. If not, the "NO" branch is followed back to step 1332 to continue the search for abnormal rig load levels on the monitor 48. Otherwise, the "YES" branch is followed to step 1334.

In step 1334, an inquiry is conducted to determine if the abnormally high load levels are generally confined to one area of the rod pull data. As shown in FIG. 14, the exemplary rig load chart 1410 shows abnormally high rig load data 1425 that is generally confined to a small portion of the rod pull activity while the remaining data is generally below the average load level 1420. If the abnormally high load levels are generally confined to one area of the rod pull data on the rig load chart, then the "YES" branch is followed to step 1336, where the supervisor identifies the problem as the paraffin level in the tubing and records the problem in the computer 100.

In step 1338, the supervisor views the monitor 48 and counts the remaining number of load peaks for this activity that are subsequent to the abnormally high load peaks caused by the paraffin 1425. In step 1340, the supervisor calculates the paraffin level by multiplying the number of load peaks subsequent to the peaks caused by the paraffin level 1425 by the length of the rods 62 being pulled from the well 58. In step 1342, an inquiry is conducted to determine if there is another activity to analyze on the rig load chart. If so, the "YES" branch is followed to step 1344, where counter variable X is incremented by one. The process returns from step 1344 to step 1310 to identify the next activity. If the rig load chart does not contain any additional activities to analyze, the "NO" branch is followed to the END step.

Figure 15:
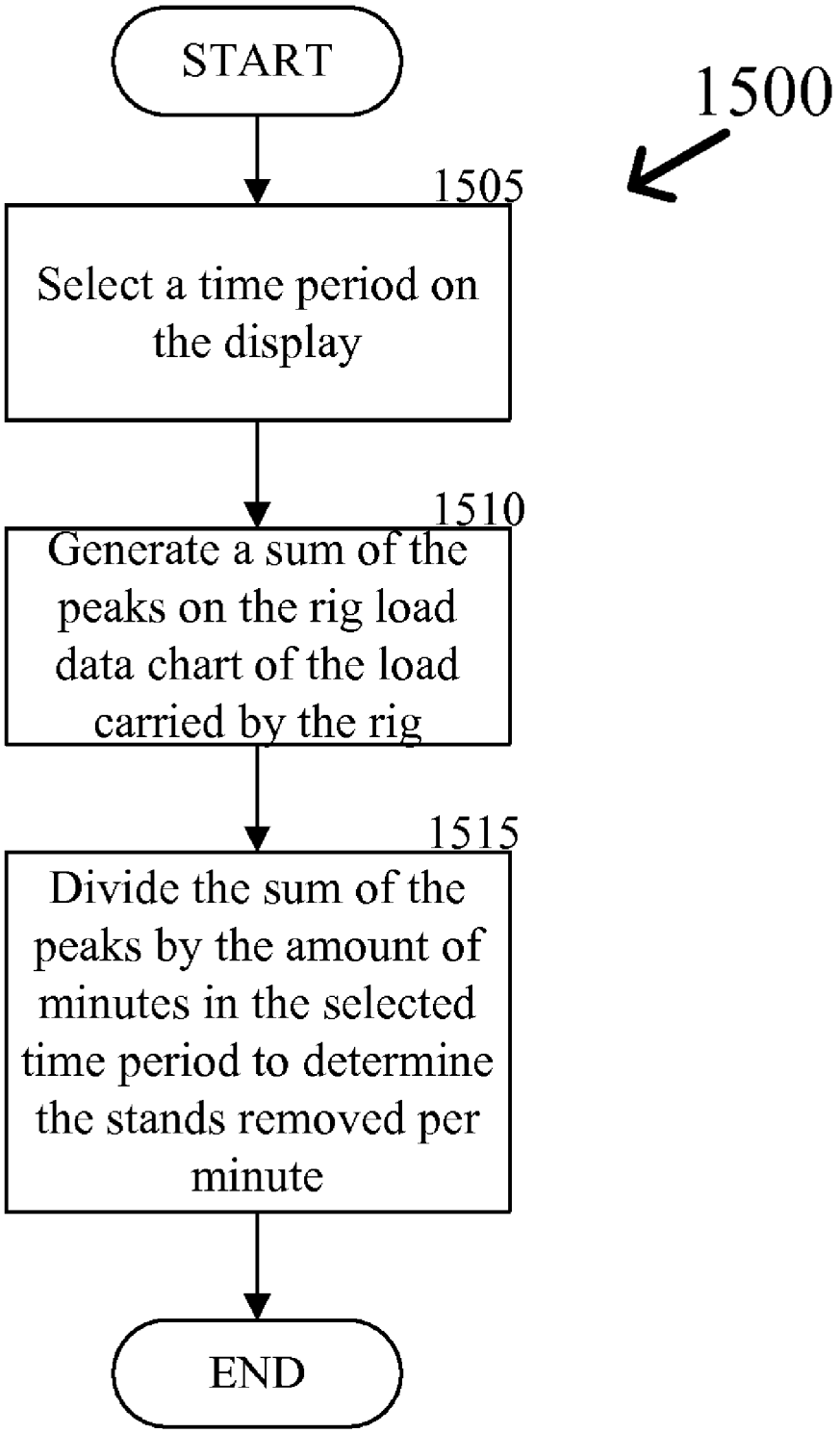
FIG. 15 is a flowchart for determining the speed of the removal of tubing or rods from a well based on an evaluation of the rig load data chart according to one exemplary embodiment of the present invention.

FIG. 15 represents an exemplary method 1500 for determining the speed of the removal of tubing or rods from a well based on an evaluation of the rig load data chart according to one exemplary embodiment of the present invention. Now referring to FIGS. 1, 10, and 15, the exemplary method 1500 begins at the START step and continues to step 1505, where a time period 1020 is selected on chart of the display 1000. In one exemplary embodiment, FIG. 10 shows a selection of an approximately twenty-six minute time period 1020 between 8:58 and 9:24. In step 1510, the sum of the data peaks 1025 (and others peaks not specifically pointed out) on the display 1000 within that time period 1020 is determined. In one exemplary embodiment, the number of data peaks 1025 is determined by the remote computer 100; however other methods known to those of ordinary skill in the art, including having the operator count the number of data peaks 1025 within the selected time range 1020, are within the scope of the present invention.

In step 1515, the sum of the data peaks 1025 on the display 1000 within the time period 1020 is divided by the number of minutes selected in the time period 1020. In the exemplary embodiment shown in FIG. 10, the number of data peaks, fifty-five, is divided by the number of minutes within the time period 1020, twenty-six minutes, to arrive at a rod removal speed of approximately 2.1 stands per minute. Those of ordinary skill in the art will recognize that the method described in FIG. 15 can be used to also determine rod insertion speed as well as tubing insertion and removal speeds by analyzing charts representing those activities. In addition, those of ordinary skill in the art will recognize that the method described in FIG. 15 can be modified to sum the troughs in the rig weight data curve, instead of the data peaks, in step 1510 to determine the removal or insertion speeds of rods or tubing. The process continues from step 1515 to the END step.

Although the invention is described with reference to a preferred embodiments, it should be appreciated by those skilled in the art that various modifications are well within the scope of the invention. Therefore, the scope of the invention is to be determined by reference to the claims that follow. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those or ordinary skill in the art, and ways of constructing other embodiments of the present invention will suggest themselves to practitioners of the art. Therefore, the scope of the present invention is to be limited only by any claims that follow.

I claim

1. A method of determining a speed of insertion or removal of piping from a well bore by evaluating a display of load data comprising the steps of:

receiving from a transducer load data comprising a plurality of load data points;

transmitting the plurality of load data to a monitor comprising a display;

receiving at the monitor the plurality of load data points comprising a load data curve on the display, the load data curve comprising a plurality of data peaks;

selecting at the monitor a time period on the display, the time period comprising at least one of the plurality of data peaks;

determining with a computer communicably coupled to the monitor the total number of data peaks received on the display during the time period;

calculating with the computer the speed of insertion or removal of the piping from the well bore by dividing the total number of data peaks by the amount of time in the time period; and generating as an output on the monitor the speed of insertion or removal of the piping from the well bore.

2. The method of claim 1, wherein the display comprises a chart on a visual display device.

3. The method of claim 1, wherein the display comprises a plotter.

4. The method of claim 1, wherein the load data points comprise rig load data from a well service rig.

5. A method of determining a speed of insertion or removal of piping from a well bore by evaluating a display of load data comprising the steps of:

receiving from a transducer load data comprising a plurality of load data points;

transmitting the plurality of load data to a monitor comprising a display;

receiving at the monitor the plurality of load data points and displaying the load data points as a load data curve on the display, the load data curve comprising a plurality of data troughs;

selecting at the monitor a time period on the display, the time period comprising at least one of the plurality of data troughs;

determining with a computer communicably coupled to the monitor the total number of data troughs received on the display during the time period;

calculating with the computer the speed of insertion or removal of the piping from the well bore by dividing the total number of data troughs by the amount of time in the time period; and generating as an output from the computer the speed of insertion or removal of the piping from the well bore.

6. The method of claim 5, wherein the display comprises a chart on a visual display device.

7. The method of claim 5, wherein the display comprises a plotter.

8. The method of claim 5, wherein the load data points comprise rig load data from a well service rig.

9. The method of claim 1, wherein the load data curve is presented on a video display device.

10. The method of claim 1, wherein the transducer comprises a load sensor at the service rig.

11. The method of claim 10, wherein the load sensor at the service rig is a hydraulic pad.

12. The method of claim 1, further comprising the step of recording the load data points in a computer storage medium.

13. The method of claim 5, wherein the load data curve is presented on a video display device.

14. The method of claim 5, wherein the transducer comprises a load sensor at the service rig.

15. The method of claim 14, wherein the load sensor at the service rig is a hydraulic pad.

16. The method of claim 5, further comprising the step of recording the load data points in a computer storage medium.

17. A method of determining a speed of insertion or removal of piping from a well bore comprising the steps of:

receiving from a transducer load data comprising a plurality of load data points;

transmitting the plurality of load data to a monitor communicably coupled to the transducer, said monitor comprising a display;

receiving at the monitor the plurality of load data points and displaying the load data points on the display, the load data points comprising a plurality of data peaks or data troughs and a time reference associated with each said load data point;

calculating with a computer communicably coupled to the monitor the speed of insertion or removal of the piping from the well bore based on a number of said data peaks or data troughs and the time associated with said data peaks or data troughs;

generating as an output from the computer the speed of insertion or removal of the piping from the well bore.

18. The method of claim 17, wherein the display comprises a chart on a visual display device.

19. The method of claim 17, wherein the display comprises a plotter.

20. The method of claim 17, wherein the load data points comprise rig load data from a well service rig.

21. The method of claim 17, wherein the transducer comprises a hydraulic pad at a well service rig.

22. The method of claim 17, further comprising the step of recording the load data points with the associated time in a computer storage medium.

* * * * *